US005540032A

United States Patent [19]

Sosnik et al.

[11] Patent Number: 5,540,032

[45] Date of Patent: Jul. 30, 1996

[54] METHOD AND APPARATUS FOR ATTACHING HEADERS TO PLASTIC BAGS

[75] Inventors: Dov Sosnik, Raanana; Reuven Ascher, Kiryat Ono, both of Israel

[73] Assignee: Elpack Packaging Systems, Ltd., Even Yehuda, Israel

[21] Appl. No.: 291,993

[22] Filed: Aug. 17, 1994

[30] Foreign Application Priority Data

May 12, 1994 [IL] Israel ..... 109648

[51] Int. Cl.[6] ..... B65B 9/00

[52] U.S. Cl. ..... 53/415; 53/551; 53/451; 53/136.5; 53/374.8; 156/569

[58] Field of Search ..... 53/415, 479, 136.1, 53/136.5, 374.8, 451, 551; 493/210; 156/569, 570, 571, 573

[56] References Cited

U.S. PATENT DOCUMENTS

| | | | |
|---|---|---|---|
| 3,543,466 | 11/1968 | Forsberg | 53/136.5 |
| 3,723,228 | 3/1973 | Schaltegger | 156/571 |
| 4,091,595 | 5/1978 | Pelster et al. | 53/136.5 |
| 4,302,277 | 11/1981 | Ilsemann | 156/570 |
| 4,338,761 | 7/1982 | Gess | 53/136.5 |
| 4,895,614 | 1/1990 | Trouteaud et al. | 156/571 |
| 5,112,430 | 5/1992 | Hudson | 156/569 |

*Primary Examiner*—John Sipos
*Assistant Examiner*—Ed Tolan
*Attorney, Agent, or Firm*—Sherman and Shalloway

[57] ABSTRACT

A method, apparatus and system for sealing filled bags with headers using high speed automated bag sealing apparatus using a header strip aligned against a side of said bag in a predetermined position and simultaneously sealing said bag and said header strips to said bag with said high speed automated bag sealing apparatus.

16 Claims, 6 Drawing Sheets

METHOD AND APPARATUS FOR ATTACHING HEADERS TO PLASTIC BAGS

The present invention relates to a method and apparatus for labelling of packages with automated high speed packaging machines, particularly for sealing bags with headers during the bag sealing operation.

BACKGROUND OF THE INVENTION

It is common today in supermarkets and hardware stores, to find articles packaged in plastic bags with paper or foil headers sealing the bag. These headers have a hole in the center to permit hanging the bag on a nail or other hook with other bags of the same article, one in front of the other. This form of storing and displaying packages is much more efficient and economical than putting them on shelf space. The bags are suitable for packaging most dry goods such as, for example, food articles like potato chips, cookies, etc.,and small hardware items such as nails, screws, washers etc., just to name a few. The manufacture of this type of packaging is also very efficient and fast, since the machines for producing these packages operate continuously and at very high speeds as follows. A plastic sleeve is held in a vertical position, is sealed on the bottom, forming a bag, which is then filled with the desired product and sealed just above the product area. The sealed bag is cut from the sleeve leaving the sleeve with a sealed bottom. The bag is then conveyed to a second station for mounting thereon a printed header containing relevant information concerning the product, its manufacturer etc. The remaining sleeve with sealed bottom goes through the same process, i.e. it is filled, sealed, cut and the bags conveyed for attaching a header. With the present machines, the filling and sealing operations proceed at very high speeds and a bottleneck generally occurs when attaching the header. The header itself is comprised of a strip of paper or foil which may have an adhesive or heat sealable backing and a crimp for folding it in half. When the sealed bag is brought to the header station, the header is folded over the sealed edge of the bag from above and stapled onto the bag or sealed on the bag under heat and/or pressure, so that the upper portion of the header is firmly attached to the package. The bottom of the header is generally loose and conforms to the curvature of the filled bag, but is not necessarily sealed to it. A hole for hanging the bag is provided in the upper portion of the header. This hole may be pre-punched or made subsequent to sealing the header to the bag. Since the attachment of the header requires that the bag be stationary for a significant amount of time while the header is fitted onto it from above and heat sealed, this part of the process holds up the entire packaging process. Furthermore, fitting the header directly above the top of the bag and aligning it is also a problem and slows up the operation.

It is the object of the present invention to provide a method of attaching headers to filled bags automatically and continuously at a faster rate than is presently possible.

A further object of the present invention is to provide an apparatus for sealing headers on filled bags.

Another object of the present invention is to provide a system of packaging plastic bags with headers automatically, quickly and efficiently.

Still another object is to provide a chain of any number of plastic bags with headers for easy display of the bags.

In accordance with the present invention, there is thus provided a method for simultaneously sealing filled bags with headers using high speed automated bag sealing apparatus comprising providing a filled bag for sealing, providing a header strip aligned against a side of said bag in a predetermined position and simultaneously sealing said bag and said header strip to said bag with said high speed automated bag sealing apparatus. Apparatus for simultaneously sealing filled bags together with headers at high speeds is also provided.

BRIEF DESCRIPTION OF THE DRAWINGS

The present invention will be better understood and appreciated from the following detailed description taken in conjunction with the drawings, in which.

DETAILED DESCRIPTION OF THE INVENTION

Figure 1:
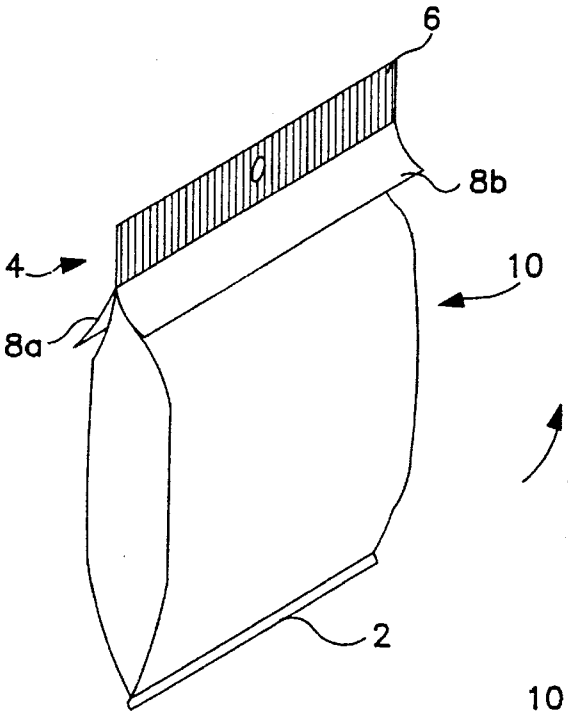
FIG. 1 shows a filled bag with header.

Referring now to FIG. 1, there is shown a bag 10, generally produced from plastic film, with two sided header 4. The bag 10 is sealed at the bottom 2. The header 4 consists of a sealed section 6, extending over the bag substantially along its entire width, and non-sealed sections 8*a* and 8*b* extending from the sealed section 6, loosely following the contour on each side of the filled bag 10. In the present state of the art, this header 4 starts out as a single strip of paper, film or foil which is folded in half, mounted on the bag 10 from above and stapled or heat sealed along section 6.

Figure 2B:
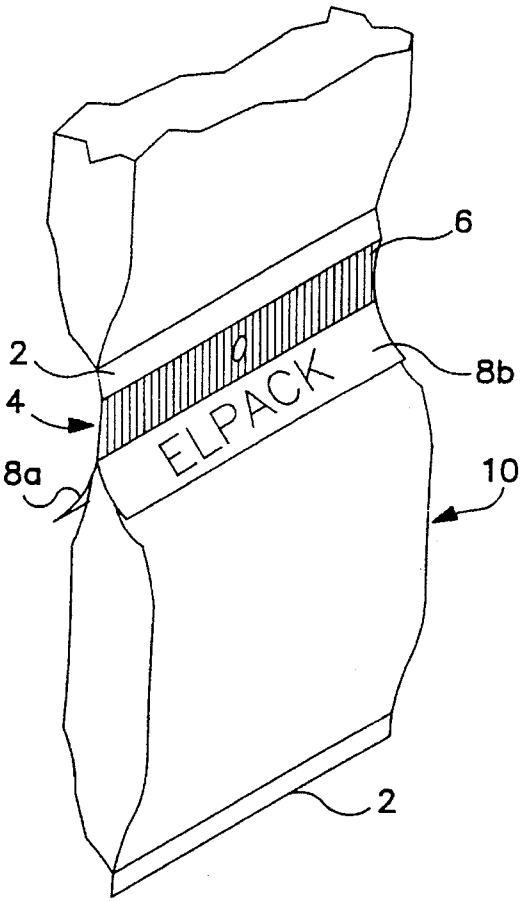
FIG. 2*b* shows a filled sealed bag with mounted header according to the present invention.
Figure 2A:
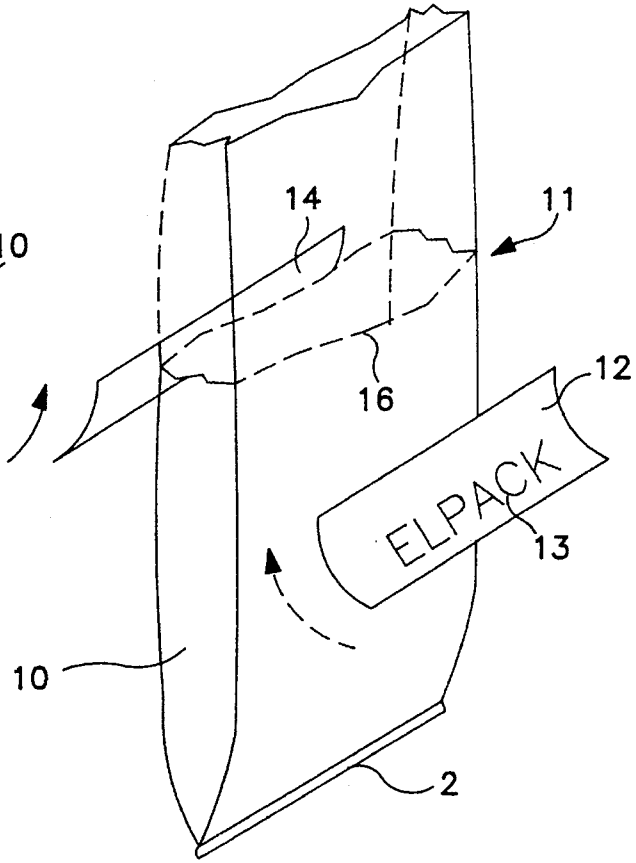
FIG. 2*a* illustrates generally how a header is mounted on a filled bag in accordance with the present invention.

Referring now to FIGS. 2*a* and 2*b*, there is shown a plastic sleeve 11, a section of which forms a bag 10, and a header comprised of two strips 12 and 14, each strip having a heat and/or pressure sealable backing. The strips 12 and 14 may have printing thereon 13. The strips 12 and 14 are pressed against the sides of the bag 10 at line 16 where the bag 10 is to be sealed from opposite sides, and the bag and strips 12 and 14 are simultaneously sealed together as shown in FIG. 2*b*. Once the header has been attached, the bag is cut from the sleeve and becomes indistinguishable from the prior art bag shown in FIG. 1.

Figure 3A:
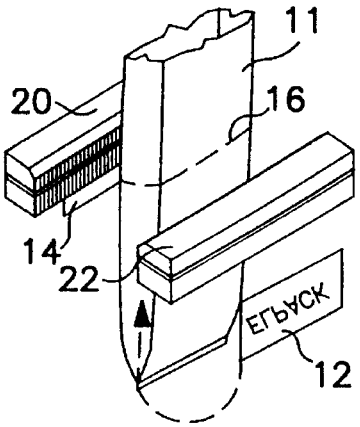
FIGS. 3*a*–3*e* schematically illustrate different stages of the process of simultaneously sealing a filled bag together with a header according to the invention.
Figure 3B:
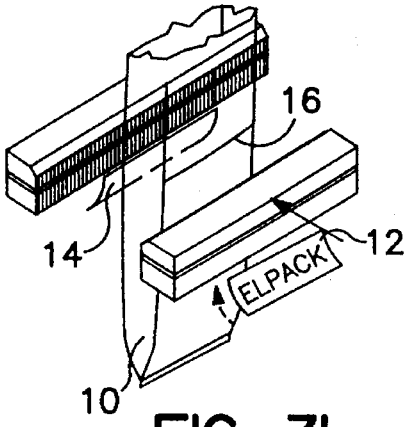
Figure 3C:
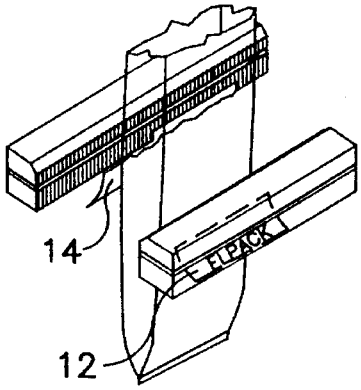
Figure 3D:
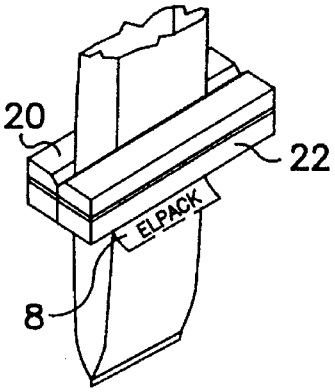
Figure 3E:
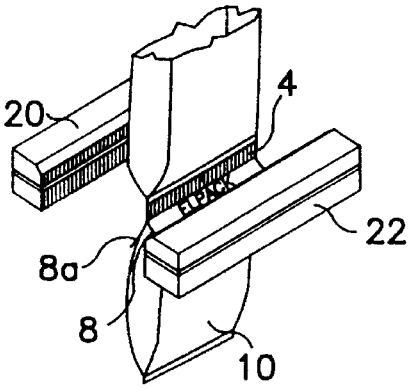

Referring now to FIGS. 3*a*–3*e*, there are shown, schematically, different stages of the production of the header bag. The filled sleeve 11 is placed between two heat sealing jaws 20 and 22 and two opposing header strips 12 and 14 are conveyed from their initial position (FIG. 3*a*) behind the jaws 20, 22 into position between the jaws 20 and 22 and the sleeve 11 along the sealing line 16, by rotation (FIGS. 3*b*, 3*c*). The sealing jaws 20 and 22 are then brought forward to press on the sleeve 11 along sealing line 16 with the header strips in place (FIG. 3*d*). When the sealing elements 20 and 22 are withdrawn (FIG. 3*e*), a sealed bag 10 together with header 4 and free ends 8 and 8*a* on both sides is provided.

Figure 4A:
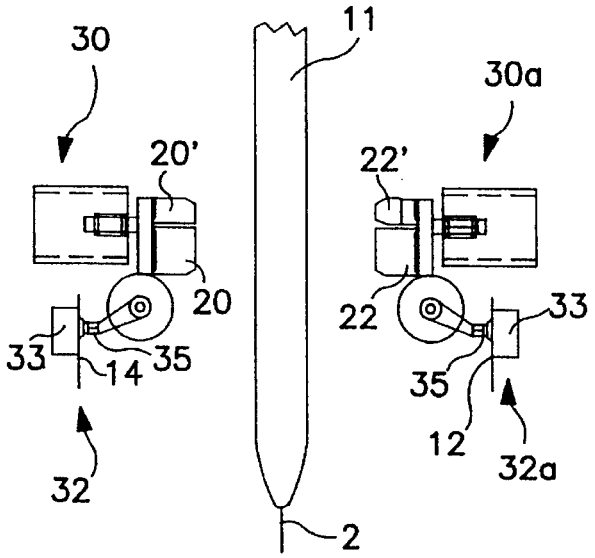
FIGS. 4*a*–4*c* schematically illustrate in said view the process of simultaneously sealing a bag and mounting thereon a header in accordance with the invention.
Figure 4B:
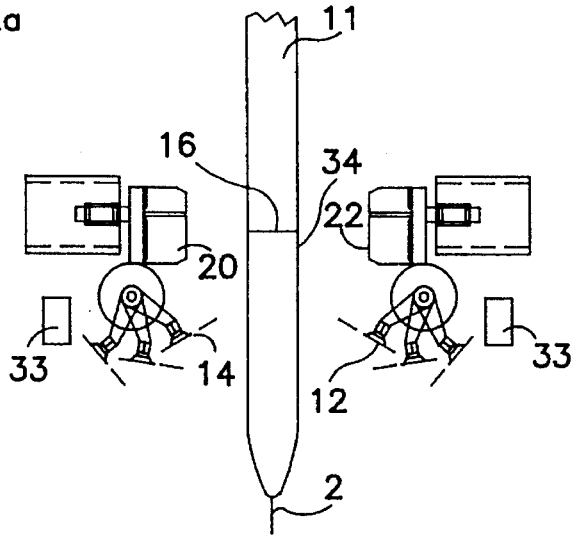
Figure 4C:
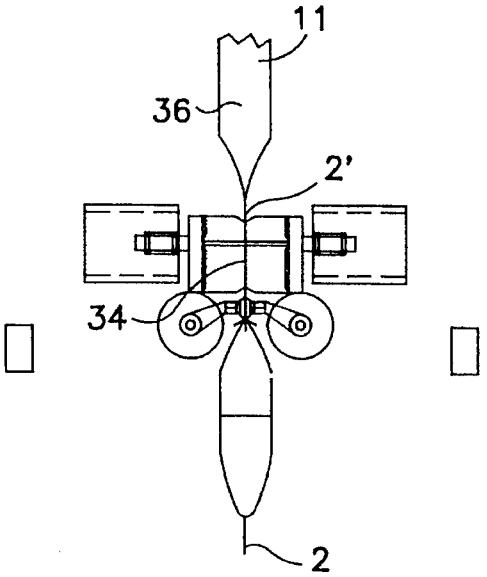

FIGS. 4*a*–4*c* illustrate this process in more detail. A plastic film sleeve 11 is sealed on the bottom 2 and filled. The bag is then brought into position for sealing with apparatus 30 and 30*a* comprising heat sealing jaws 20, 20' and 22, 22' respectively. Cooperating with the heat sealing jaws 20, 20' and 22, 22' are suction apparatus 32 and 32*a*, consisting of a vacuum box 33 and vacuum pad 35, which transfer cut header strips 14 and 12 from their respective stacks (see FIG. 5) by means of suction. The suction apparatus 32, 32*a* rotate the header strips 12 and 14 (FIG. 4*b*) under and around the sealing jaws 20, 22 respectively up to sealing line 16 to a position next to section 34 of the filled sleeve bag 10. The sealing jaws 20 and 22 are then brought close together to press on the strips 12 and 14 and the bag section 34, sealing the bag simultaneously together with the header strips on both sides of the bag. The upper sections of the sealing jaws 20' and 22' create a bottom seal 2' for the next bag 36 to be produced from sleeve 11.

Figure 5:
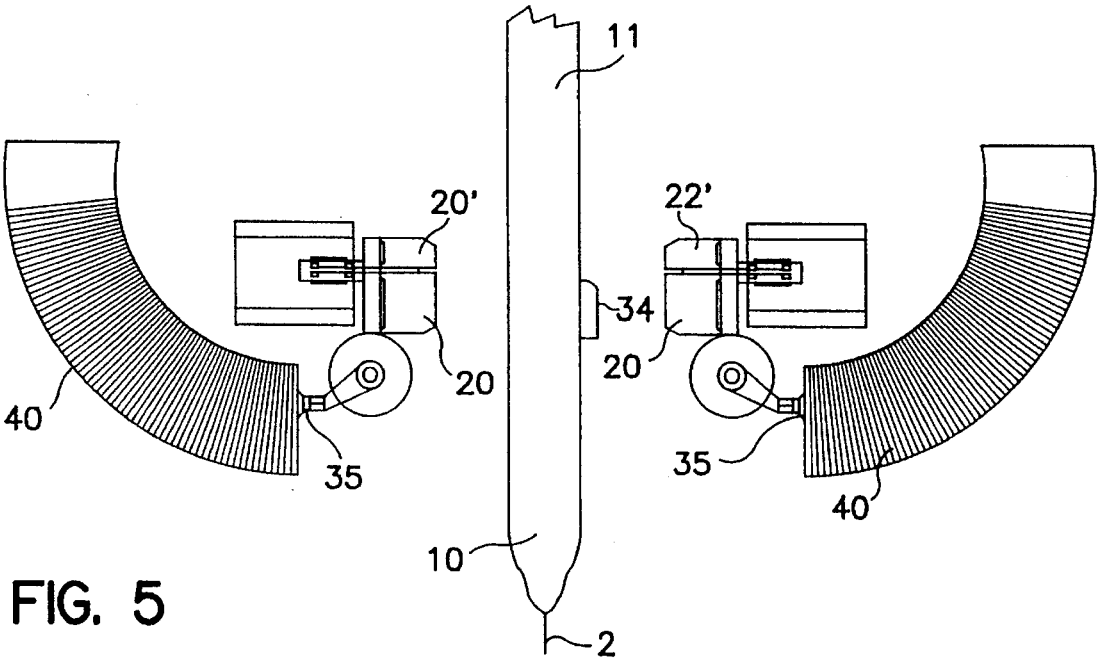
FIG. 5 schematically illustrates an apparatus for simultaneously sealing a bag and mounting thereon a header with strips in accordance with the invention.

FIG. 5 illustrates schematically stacked header strips 40 which are individually transferred by vacuum pads 35 opposite section 34 of bag 10 for sealing on both sides of the bag 10 by sealing jaws 20, 22.

Figure 6:
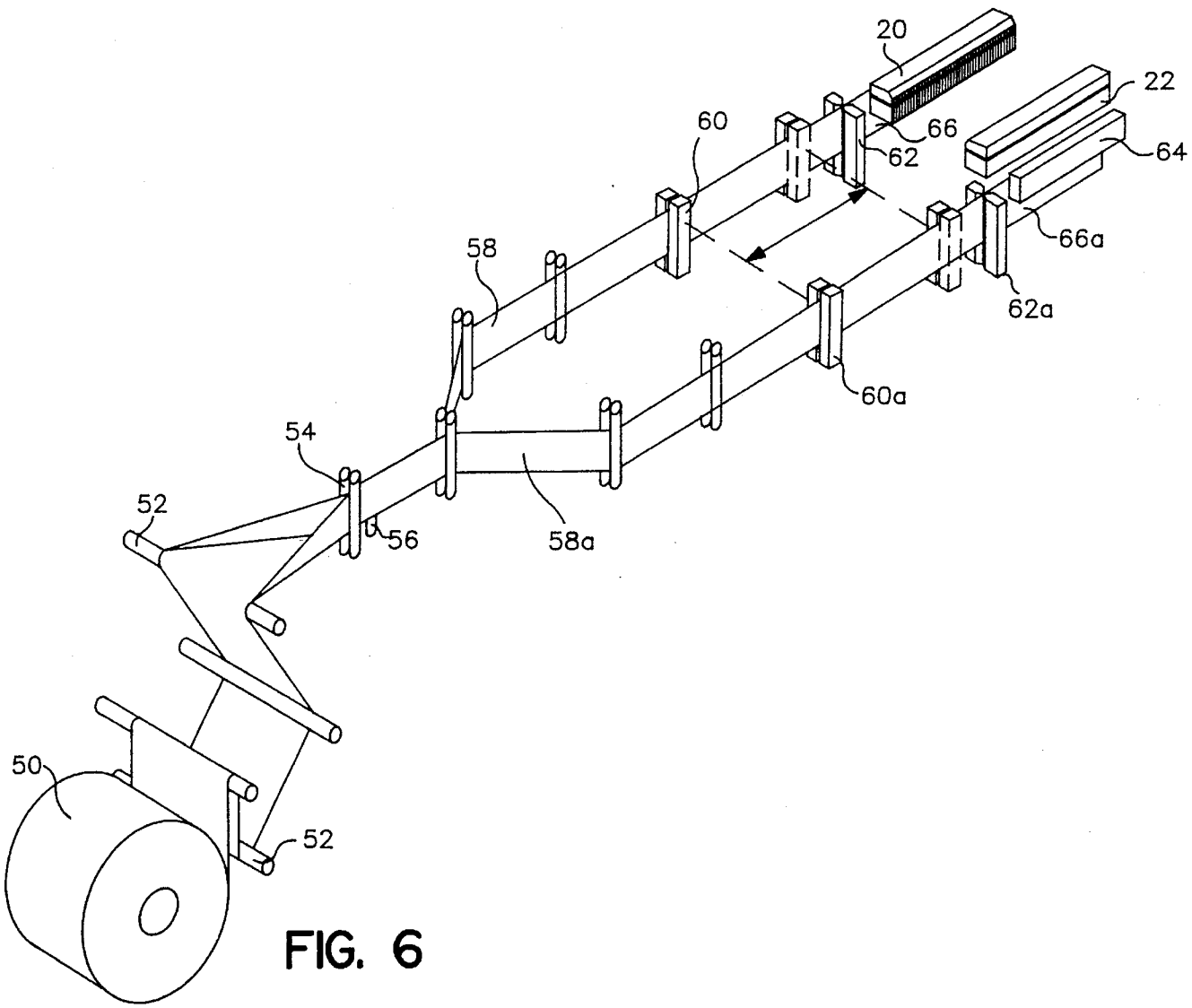
FIG. 6 schematically illustrates an apparatus for simultaneously sealing a bag and mounting thereon a header from a roll in accordance with a preferred embodiment of the invention.

In another embodiment, shown in FIG. 6, the header strip can start out as a single reel of film 50, which is unwound by unwinders 52 and folded with the aid of film guides 54. A knife 56 slits the film 50 into two halves 58 and 58*a*. These parallel strips 58 and 58*a* are advanced by drive arms 60 and 60*a* to line up with the sealing jaws 20 and 22. Cutting knives 62, 62*a* cut the films 58 and 58*a* to the proper strip lengths 66 and 66*a* required for the header. The strips 66 and 66*a* are held in position by suction apparatus 64. The strips 66 and 66*a* are then transferred to the sides of a bag (not shown) between the sealing jaws 20, 22, as illustrated in FIGS. 4*a*–4*c*, and the bag is sealed together with the strips. Drive arms 60 and 60*a* advance the split film so that two more strips can be cut and sealed onto a bag. This method assures complete uniform alignment of strips 66, 66*a* opposite each other on the bag.

A hole can be pre-punched on both strips of header 66, 66*a* or it can be made subsequent to sealing the header to the bag.

Figure 7A:
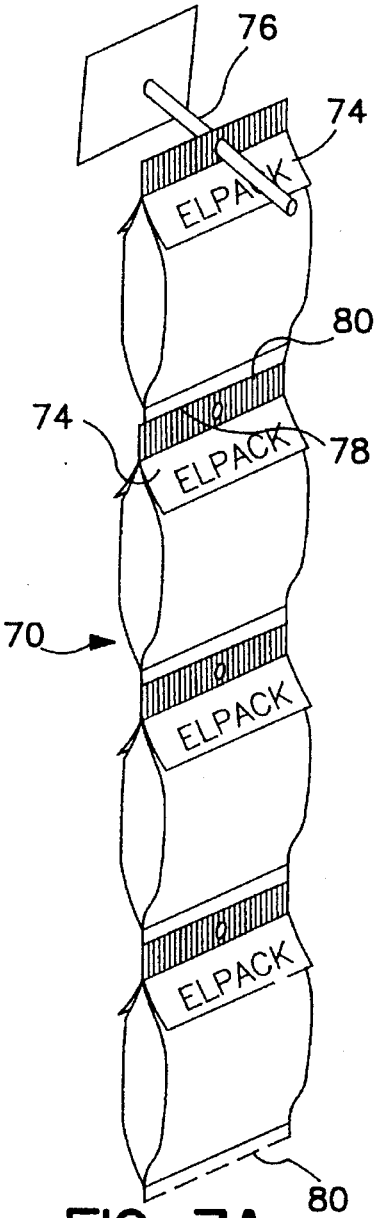
FIGS. 7*a*–7*c* show chains of bags with headers attached to one another.
Figure 7B:
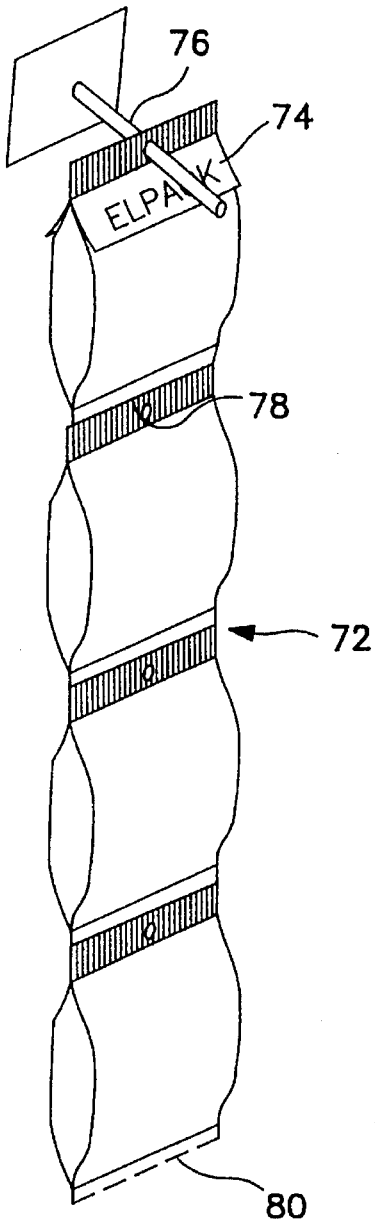
Figure 7C:
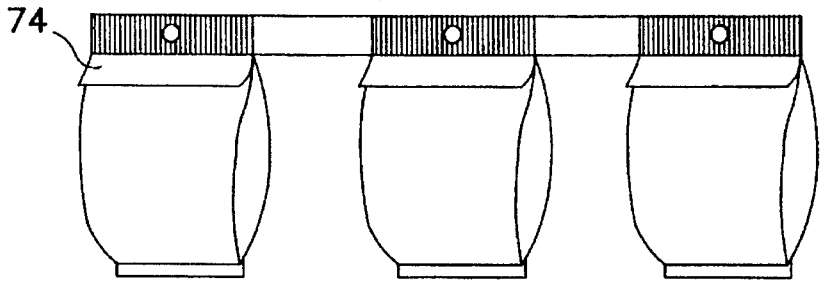

Referring now to FIGS. 7*a*–7*c*, there are illustrated chains of bags. The vertical chain of FIG. 7*a* has a header 74 mounted on each bag, whereas the vertical chain of FIG. 7*b* has only one header 74 on the top bag, leaving the rest of the bags in the chain headerless. The top bag in both of these chains is generally hung on a peg 76 stuck through hole 78 on the header 74. Thus, if one wishes ho sell several bags as a single sales item, one only has to mount a single header for every group of bags in the item as in FIG. 7*b*. If, on the other hand, each bag is to be sold separately, then each bag is provided with a header as in in FIG. 7*a*. Generally, the bags can be detached from one another by tearing a perforated line 80 separating the bags.

FIG. 7*c* shows a chain of horizontal bags with headers 74 similar to those of FIG. 7*a*.

In the same way that a header can be provided on both sides of a bag, it is possible to provide a one sided header by providing a strip on only one side of the bag for simultaneous sealing with the bag.

It will be appreciated by persons skilled in the art that the scope of the present invention is not limited to what has been shown and described above merely by way of example. The scope of the present invention is limited, rather, solely by the claims which follow.

We claim:

1. A method for simultaneously sealing and providing with headers a chain of filled bags using high speed automated bag sealing apparatus comprising:

providing a sleeve for a plurality of bags to form said chain, said sleeve being sealed at one end forming a bag, said sleeve having two side walls, filling said sleeve to a predetermined level, aligning a header strip against a side wall of said sleeve above said predetermined level, and simultaneously sealing together the header strip and both side walls above said predetermined level, thus forming one sealed bag with header and also forming a bottom seal for the next bag on the sleeve.

2. Apparatus for sealing and providing with headers a chain of filled bags using high speed automated bag sealing apparatus comprising:

means for filling a bag formed from a sleeve for a plurality of bags to form said chain, said sleeve having two side walls and being sealed at one end, to a predetermined level, means for aligning a separate sealable header strip against a side wall of said sleeve above said predetermined level, and means for simultaneously sealing together the header strip and both side walls above said predetermined level to form a sealed bag and also forming a bottom seal for the next bag on the sleeve.

3. A method as claim 1, further comprising severing the sealed bag from the sleeve.

4. Apparatus as in claim 2 further comprising means for aligning two separate header strips on opposite sides of the sleeve to produce a two-sided header.

5. Apparatus as in claim 2 further comprising means for severing the sealed bag from the rest of the sleeve.

6. A method as in claim 1 comprising aligning two separate header strips against opposite side walls of said sleeve above said predetermined level to produce a two sided header.

7. A method as in claim 6, wherein the separate header strips are provided from two separate header strip stacks.

8. A method as in claim 6, wherein the separate header strips are provided from a split film.

9. A method as in claim 6, wherein the separate header strips are transferred to the sealing position by means of suction.

10. A method as in claim 1, wherein the bags are severably connected to form said chain of bags and sealing at least one of said bags with a header strip.

11. A system of packing plastic bags with headers using automated high speed operations comprising:

apparatus for making and sealing bags from film sleeves forming a chain of a plurality of bags means for filling a bag formed from said sleeve to a predetermined level, said sleeve having two side walls and being sealed at one end, means for aligning two separate sealable header strips on opposite sides of the bag to be sealed at predetermined positions;

means for simultaneously sealing said header strips together with the sides of said bag and forming a bottom seal for the next bag on the film sleeve in one cycle; and means for collecting said header bags.

12. A system as in claim 11 for providing a chain of bags severably attached to one another, having at least one bag sealed with a header strip.

13. A method in accordance with claim 6, wherein the separate header strips are aligned parallel to each other on opposite sides of the bag.

14. Apparatus in accordance with claim 2, further comprising means for aligning the separate header strips parallel to each other on opposite sides of the bag.

15. A system in accordance with claim 11, further comprising means for aligning the separate header strips parallel to each other on opposite sides of the bag.

16. An apparatus as in claim 2 which further comprises means for preparing plastic film sleeves from sheets of film.

* * * * *